US005704244A

United States Patent [19]

Halasz et al.

[11] Patent Number: 5,704,244

[45] Date of Patent: Jan. 6, 1998

[54] APPARATUS FOR RESHAPING A CONTAINER

[75] Inventors: Andy Halasz, Crystal Lake, Ill.; Rolf Wirz, Lutzelfluh, Switzerland; Rene Ménéghin, Lamurette; Louis Trepied, Voreppe, both of France

[73] Assignee: American National Can Company, Chicago, Ill.

[21] Appl. No.: 473,506

[22] Filed: Jun. 7, 1995

[51] Int. Cl.[6] ..... B21D 22/00; B21D 41/02

[52] U.S. Cl. ..... 72/353.6; 72/393

[58] Field of Search ..... 72/393, 353.6, 72/347, 348, 379.4, 61, 62, 428, 367

[56] References Cited

U.S. PATENT DOCUMENTS

| | | | |
|---|---|---|---|
| 2,063,013 | 12/1936 | Cooper . | |
| 2,139,143 | 12/1938 | Wiswell . | |
| 2,198,873 | 4/1940 | Hinsdale | 72/353.6 |
| 3,198,374 | 8/1965 | Lindner et al. . | |
| 3,353,700 | 11/1967 | Kalina . | |
| 3,759,203 | 9/1973 | Frankenberg . | |
| 3,797,431 | 3/1974 | Yoshimura | 72/348 |
| 3,872,994 | 3/1975 | Hyde . | |
| 3,947,950 | 4/1976 | Adams | 72/393 |
| 3,953,994 | 5/1976 | Brawner et al. . | |
| 4,058,998 | 11/1977 | Franck et al. | 72/84 |
| 4,324,340 | 4/1982 | Belokin, Jr. . | |
| 4,380,165 | 4/1983 | Post | 72/353.6 |
| 4,389,147 | 6/1983 | Van Alsburg . | |
| 4,487,048 | 12/1984 | Frei . | |
| 4,502,308 | 3/1985 | Kelly . | |
| 4,751,836 | 6/1988 | Breese . | |
| 4,751,839 | 6/1988 | Thomas | 72/353.6 |
| 4,947,667 | 8/1990 | Gunkel et al. . | |
| 5,022,254 | 6/1991 | Kramer | 72/393 |
| 5,058,408 | 10/1991 | Leftault, Jr. et al. . | |
| 5,100,017 | 3/1992 | Ishinabe et al. . | |
| 5,187,962 | 2/1993 | Bilko et al. . | |
| 5,228,321 | 7/1993 | Shibasaka . | |
| 5,341,667 | 8/1994 | Lee, Jr. | 72/379.4 |
| 5,355,709 | 10/1994 | Bauder et al. | 72/393 |
| 5,355,710 | 10/1994 | Diekhoff . | |
| 5,397,021 | 3/1995 | Usui . | |
| 5,533,373 | 7/1996 | Plester . | |

FOREIGN PATENT DOCUMENTS

| | | |
|---|---|---|
| 393 240 | 9/1991 | Austria . |
| 0 492 861 | 7/1992 | European Pat. Off. . |
| 0 520 693 | 12/1992 | European Pat. Off. . |
| 54-150365 | 5/1979 | Japan . |
| 57-168737 | 11/1982 | Japan . |
| 59-197323 | 11/1984 | Japan . |
| 60-092028 | 5/1985 | Japan . |
| 60-92028 | 5/1985 | Japan . |
| 62 207521 | 9/1987 | Japan . |
| 01 299723 | 12/1989 | Japan . |
| 03 161129 | 7/1991 | Japan . |
| 2 224 965 | 5/1990 | United Kingdom . |
| WO A 96/25256 | 8/1996 | WIPO . |
| WO96/20798 | 11/1996 | WIPO . |

OTHER PUBLICATIONS

Joseph B. Cahill, "Firm Builds Coke a Can With Curves," Aug. 7, 1955, p. 4, *Crains Chicago Business.*

"The Pressure Is On Reformed Cans" Jan. 1994 The Can-Maker, p. 7.

"Pneumatic Forming Breaks The Mould" Mar. 1994 The Canner.

*Primary Examiner*—Lowell A. Larson
*Assistant Examiner*—Rodney A. Butler
*Attorney, Agent, or Firm*—Wallenstein & Wagner, Ltd.

[57] ABSTRACT

A seamless drawn and ironed container body having a side wall with portions of the side wall expanded radially outward from an initial cylindrical configuration and a method and apparatus for reshaping such containers.

5 Claims, 14 Drawing Sheets

FIG. 3
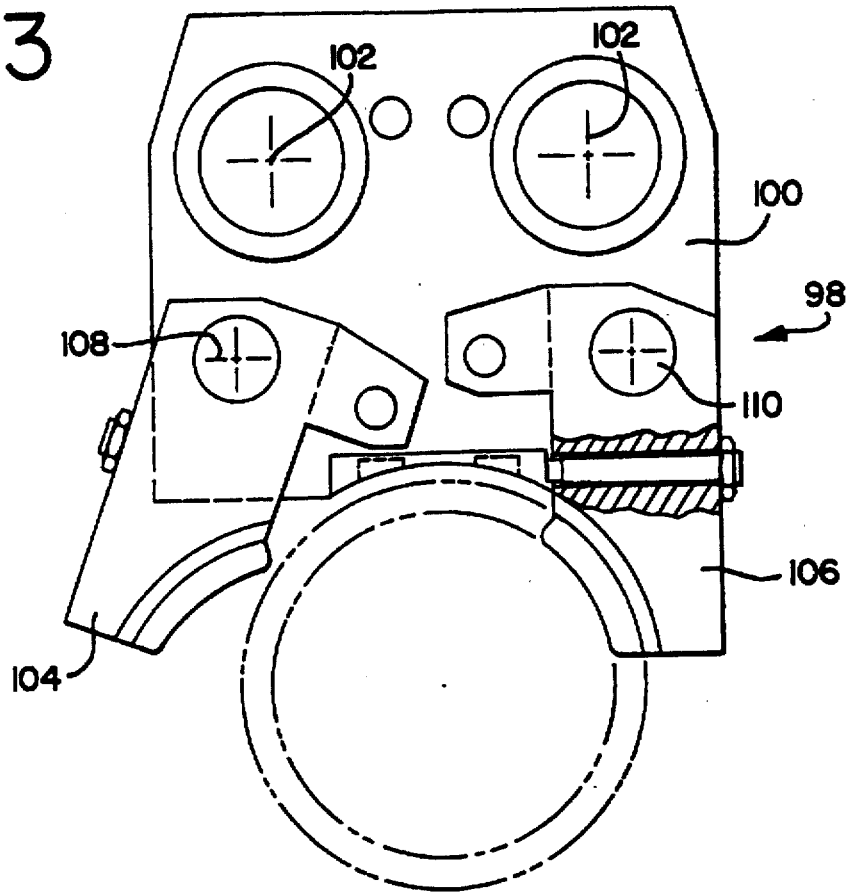
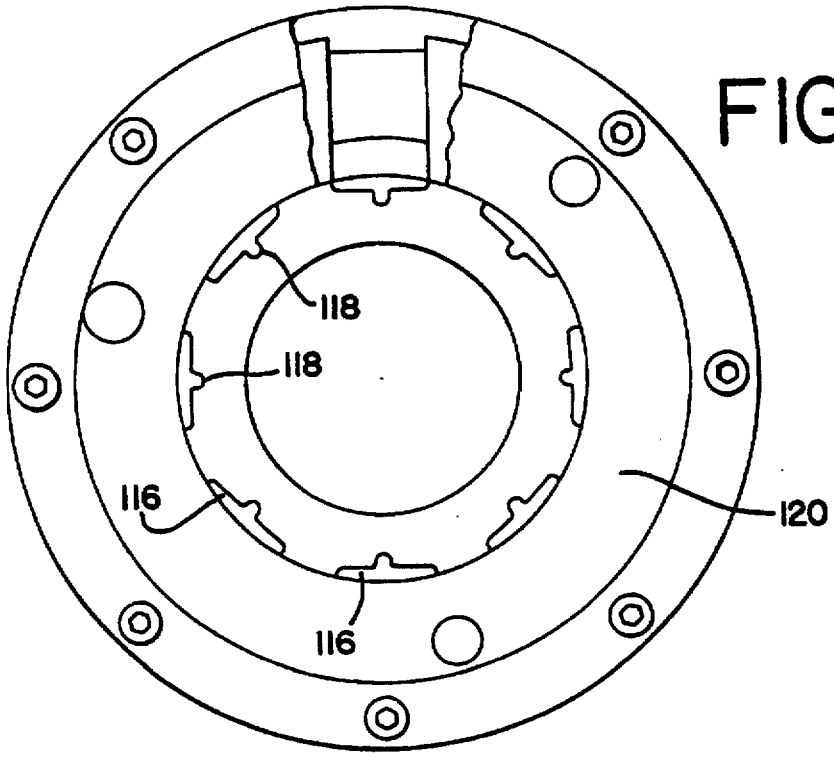
FIG. 5

APPARATUS FOR RESHAPING A CONTAINER

TECHNICAL FIELD

The present invention generally relates to a reshaped seamless container body and to a method and apparatus for reshaping such a container body, and more particularly, to a seamless drawn and ironed beverage container body having portions of a side wall expanded radially outward from an initial cylindrical shape, and to a method and apparatus for expanding the side wall of the container body.

BACKGROUND OF THE INVENTION

The present invention relates to reshaping the side wall of a drawn and ironed seamless container body. Such container bodies are typically used for beverages and are constructed from a single disc of metal, sometimes referred to as a blank. The metal disc is typically an aluminum alloy. The metal disc is first formed into a cup having a bottom wall portion and a side wall extending from the bottom wall portion. The cup is then drawn and ironed to axially extend the side wall and reduce the diameter of the cup. The drawing and ironing process thins the metal in the side wall. The side wall of the container body formed in a drawing and ironing process has an initial cylindrical shape, and extends from the bottom wall portion to a neck portion at an open end of the container body opposing the bottom wall portion. The neck portion is often necked in to include a portion of reducing diameter, and is provided with an outwardly directed flange.

The resultant finished container is sometimes referred to as a two-piece container. That is, the container body, which was subjected to the drawing and ironing process to form the bottom wall portion and side wall extending from the bottom wall portion, is the first piece of the container, and a container end wall, which is typically double seamed to an open end of the container body opposing the bottom wall portion, is the second piece. Due to the large number of containers made each year, the beverage container industry is constantly striving to create two-piece containers with the minimum amount of metal. The metal disc used to form the container body for a typical beverage container presently has a thickness of approximately 0.0112–0.0114 inches. The side wall is thinned to approximately one third of the initial disc thickness.

One other type of metal container commonly found is sometimes referred to as a three-piece container. A three-piece container includes a first rectangular piece of metal which is rolled into a cylindrical shape to form the side wall or cylindrical portion of the container. The sides of the rectangular piece are then welded together to form a seam along the side wall. The cylindrical portion of the three-piece container thus has two open ends. A first end wall and a second end wall are then double seamed to the open ends of the cylindrical portion, as the second and third pieces, respectively, of the three piece container. The cylindrical portion of a three piece container is typically many times thicker than the side wall of a drawn and ironed container.

Several methods and apparatuses are known for reshaping, or expanding radially outward, portions of the cylindrical portion of a three-piece container. One apparatus is disclosed in Japanese Patent Nos. 54-150365 and 57-168737. This type of apparatus includes an inner shaping mandrel with a plurality of forming segments. The forming segments are cammed radially outward to engage the inner surface of the cylindrical portion of the three-piece container and expand at least a portion of it radially outward.

Another apparatus for expanding portions of the cylindrical portion of a three piece container is disclosed in U.S. Pat. No. 4,487,048 ("Frei"). Frei is directed to forming beads in the cylindrical portion of a three piece container. As disclosed in FIG. 1 of Frei, a cylinder having two open ends is placed over an inner roll which is provided with embossing projections. Axial movement of an expanding cone forces the projections radially outward into the cylinder.

More recently, the cylindrical portion of three-piece containers have been expanded using an internal fluid pressure. The internal fluid pressure forces the cylindrical portion of the three piece container radially outward into a mold or shell having a desired configuration for the container.

Unlike the cylindrical portion of a three piece container, the container body of a two piece container includes an integral bottom wall portion. The bottom wall portion inhibits movement of the metal in the side wall and makes it extremely difficult to cold work the side wall to expand it beyond the initial cylindrical shape. Additionally, a drawn and ironed container body is extremely work hardened and brittle, and the side wall of the container body has limited ductility. Accordingly, the expansion techniques used for three-piece containers have not been used for a two-piece container body.

One method of reshaping or expanding the side wall of a drawn and ironed container which is disclosed in U.S. Pat. No. 5,058,408 ("Leftault, Jr. et al."), requires heat treatment of portions of the side wall. In Leftault, Jr. et al., heat treatment of the side walls of a drawn and ironed container was found necessary to allow successful bulging of the container side wall. Otherwise, the bulging operation could exceed the formability capability of the metal and cause catastrophic failure. The heat treatment is applied for a sufficient time and at a sufficient temperature to lower the yield strength of the side walls at least 15% to permit the subsequent bulging. Portions of the side wall are preferably heated with a conventional induction heating coil at a temperature of about 450°–650° F. for a time of about 0.25 to 10 seconds. The heat treatment causes recrystallization of the metal in the side wall to a very fine grained microstructure. After heat treatment, the side wall is bulged by mechanical or electromagnetic bulging. One apparatus for electromagnetic bulging is disclosed in U.S. Pat. No. 4,947,667.

SUMMARY OF THE INVENTION

The present invention provides an apparatus and a method for reshaping or expanding radially outward, portions of the side wall of a seamless drawn and ironed container body with out the necessity of heat treating the side wall. The present invention also provides an apparatus and method for applying an axial compressive force to the container body to assist in the reshaping operation. The present invention further provides an apparatus and method for further reshaping the expanded portions of the side wall by deforming segments of such portions radially inwardly. The axial compressing force and the radially inward deformation are not necessarily confined to a seamless drawn and ironed container body.

In accordance with one aspect of the present invention an apparatus is disclosed which comprises a shaping mandrel connected to a housing. The shaping mandrel includes a plurality of expanding forming segments, each of the forming segments having a contacting surface for engaging an interior surface of the side wall of the container body. The contacting surface of each forming segment is highly polished to a surface finish of 2–10 microns. Further, the forming segments include a first curved corner surface on a first side of the contacting surface and a second curved corner surface on a second side of the contacting surface opposed from the first side. The first and second curved surfaces have a radius of curvature of approximately 2–3 millimeters. Prior forming segments, used to expand the cylindrical portion of a three-piece container, included contacting surfaces with a finish of 20–32 microns, and relatively sharp radii of curvature on either side of the contacting surface of approximately 0.5 millimeters. Use of such prior forming segments would tear or rupture the side wall of a drawn and ironed container body.

The apparatus may further include an outer tool connected to the housing for engaging an outer surface of the side wall of the container body during the reshaping operation. The outer tool would apply a radially inward force to a portion of the side wall to deform radially inwardly segments in the side wall. The outer tool can be stationary and expansion of the forming segments of the inner shaping mandrel can move portions of the side wall into contact with the outer tool to form the radially inwardly deformed segments. Alternatively, the outer tool can include means for radially inward movement. Such means can be a camming mechanism for camming outer forming segments on the outer tool radially inward.

The shaping mandrel of the apparatus includes an actuator arm for providing radial outward movement of the forming segments. The actuator arm includes a plurality of camming surfaces for contact with the forming segments. Axial movement of the actuator arm cams the forming segments radially outward into engagement with the interior surface of the side wall of the container body.

The apparatus may further include a support platform axially aligned with the shaping mandrel for contacting the bottom wall portion of the container body. The support platform may also include means for applying a vacuum pressure between the support platform and a bottom wall of said container body to maintain contact between the support platform and the bottom wall. This assists the support platform in placing the container body over the shaping mandrel, and removing the container body after the reshaping operation. Further, the support platform may be used to apply an axial compressive force to the container body during the reshaping operation. A biasing spring connected to the support platform may be used for applying the axial force. The opposing end of the container is pressed against the housing.

Additionally, the apparatus further includes a removal sleeve connected to a guide post which is connected to the housing. The removal sleeve contacts a portion of the container body proximate the neck portion. Axial movement of the removal sleeve affects movement of the container body about the mandrel. The removal sleeve includes a first clamping jaw and a second clamping jaw. The first and second clamping jaws are pivotly mounted to the removal sleeve for engaging or clamping the neck portion of the container body.

In another aspect of the invention, an apparatus for reshaping a portion of a cylindrical side wall of a container body is disclosed. The apparatus includes a shaping mandrel connected to a housing. The shaping mandrel includes a plurality of expanding forming segments, each of said forming segments having a contacting surface for engaging an interior surface of said side wall. The apparatus further includes a support platform axially aligned with the mandrel for contacting a first end of the container body.

In yet another aspect of the invention, an apparatus for reshaping a portion of a cylindrical side wall of a container body is disclosed. The apparatus includes a shaping mandrel connected to a housing. The shaping mandrel includes a plurality of expanding forming segments, each of the forming segments having a contacting surface for engaging an interior surface of the side wall. The apparatus further includes an outer tool connected to the housing for engaging an outer surface of the side wall during a reshaping operation to apply a radially inward force to the side wall.

In yet another aspect of the invention an apparatus for reshaping a cylindrical side wall of a container body is disclosed. The apparatus comprises a flexible inner mandrel for placement in an interior of a container body. The mandrel includes a generally cylindrical centrally located channel having a first diameter and an outer shaping surface for contacting an inner surface of a side wall of the container body. The side wall having an initial cylindrical shape. The apparatus further includes a plunger including a plunger head. The plunger head has a second diameter greater than the first diameter of the centrally located channel of the mandrel wherein movement of the plunger head through the channel forces at least a portion of the outer shaping surface of the mandrel radially outward into contact with the inner surface of the side wall to expand at least a portion of the side wall radially outward from the initial cylindrical shape.

The outer shaping surface of the mandrel may include an annular recessed channel. The mandrel is preferably polyurethane or rubber.

One aspect of the method of the present invention discloses reshaping a container body having an integral bottom wall. The method includes the steps of providing a container body which has been drawn and ironed from a single metal disc, the container body having a seamless side wall extending from a bottom wall at one end, and having an opening at an end opposing the bottom wall, the side wall having an initial cylindrical shape. The method includes applying a radially outward force to an inner surface of the side wall of the drawn and ironed container body to deform at least a first portion of the side wall radially outward from the initial cylindrical shape.

The applying a radial outward force step may include inserting a shaping mandrel through the open end of the container body, wherein the shaping mandrel includes a plurality of forming segments for engaging an interior surface of the side wall. Expanding the forming segments radially outward to engage the interior surface of the side wall and expand the side wall radially outward. Collapsing the forming segments of the shaping mandrel and removing the container body from about the shaping mandrel.

The removing step may comprise engaging a portion of the container body proximate the open end with a removal sleeve and moving the container body axially away from the shaping mandrel with the removal sleeve.

The applying a radial outward force step may comprise deforming at least a portion of the side wall radially outward until such portion has a mean average diameter approximately 5–7% greater than a mean average diameter of the initial cylindrical shape.

The method may further comprise the step of applying an axial compressive force to the container body during the applying a radial outward force step. This step may comprise engaging the open end of the side wall against a stationary ring in a housing. The method further includes providing a support platform for engaging the bottom wall of the container body, and moving the support platform axially towards the container body to apply a compressive force to the container body between the support platform and the stationary ring.

The method may further comprise the step of creating a vacuum pressure between the support platform and the bottom wall of the container body to maintain engagement between the bottom wall and the support platform.

The method may further comprise the step of applying a radially inward force to the deformed, or expanded, portion of the side wall to further deform the portion of the side wall radially inwardly. The applying a radially inward force step may comprise placing a stationary outer shaping tool proximate an exterior surface of the side wall wherein the applying a radial outward force step causes the exterior surface of the side wall to engage the outer shaping tool. Alternatively, the applying a radially inward force step may comprise placing an outer shaping tool proximate an exterior surface of the side wall and moving the shaping tool radially inward to engage the side wall.

The method may further comprise the step of applying a radially outward force to the side wall of the container body to deform at least a second portion of the side wall radially outward from the initial cylindrical shape. This step can be done at the same time as the first portion is being deformed, or it can be done subsequent to forming the first portion in a progressive reshaping operation.

In another aspect of the present invention a method of reshaping a tubular element, such as side wall of seamless drawn and ironed container body or the cylindrical portion of a three-piece container is disclosed. The method comprises the steps of providing a tubular element having a first end and an opposing second end, the tubular element having an initial cylindrical shape. The method further includes applying a radially outward force to the tubular element to deform at least a first portion of the tubular element radially outward from the initial cylindrical shape and applying a radially inward force to the first portion of the tubular element to further deform the first portion of the tubular element.

A reshaped container of the present invention is also disclosed. The reshaped container comprises a seamless container body formed from a single disc of metal. The disc of metal is preferably an aluminum alloy. The container body includes a bottom wall portion at a first end of the container body having a first mean average diameter, and a cold worked side wall portion extending from the bottom wall portion to a neck portion at a second end of the container body. The neck portion is utilized to attach a container end to the container body. The side wall includes a first portion having a second mean average diameter and a second portion having a third mean average diameter greater than both the first mean average diameter and the second mean average diameter.

The neck portion may comprise a generally frustoconical portion of reducing diameter and an outwardly directed flange.

The side wall of the reshaped container may include a third portion having a forth mean average diameter less than the third mean average diameter wherein the second portion is axially disposed between the first portion and the third portion. The said side wall may further include a fourth portion having a fifth mean average diameter greater than the first mean average diameter and greater than the second mean average diameter and greater than the fourth mean average diameter wherein the third portion is axially disposed between the second portion and the fourth portion.

The side wall may also include a plurality of radially inwardly deformed segments spaced circumferentially about the second portion. The segments may extend axially along the second portion of the side wall and have an outwardly concave arcuate portion.

The third mean average diameter of said second portion of the side wall is approximately 5–7% greater than the second mean average diameter of the first portion.

Further aspects of the invention are described in the detailed description or shown in the Figures.

BRIEF DESCRIPTION OF DRAWINGS

FIG. 3 discloses a top plan view of a removal sleeve of the apparatus of FIG. 2;

FIG. 5 discloses a top plan view of an outer ring of the apparatus of FIG. 4;

DETAILED DESCRIPTION OF PREFERRED EMBODIMENTS

Figure 1:
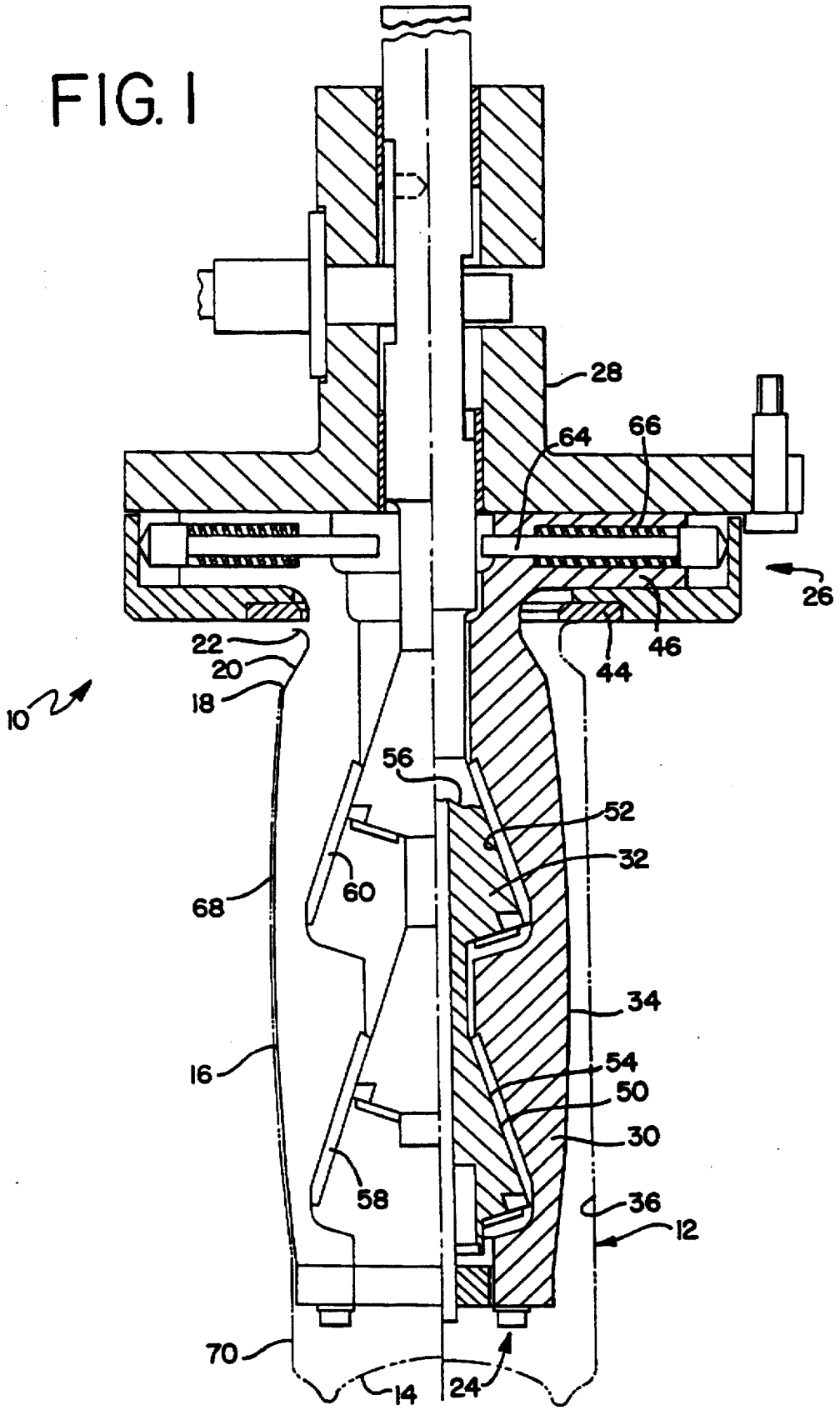
FIG. 1 discloses a cross-sectional view of an apparatus of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, an apparatus 10 is disclosed in cross-section for reshaping a container body 12. The container body 12, is formed from a single disc of metal, preferably an aluminum alloy such as an aluminum 3004 H19 temper, and is drawn and ironed in a conventional manner. The starting thickness of the metal disc is approximately 0.0112–0.0114 inches, and during the drawing and ironing process the side wall thickness is reduced to approximately one third of the starting thickness (i.e., slightly less than about 0.004 inches). The container body 12 includes a bottom wall 14 at one end and a seamless side wall 16 extending from the bottom wall 14. The side wall 16 extends to a neck portion 18 which is proximate an open end of the container body 12. For the container body 12 disclosed in FIG. 1, the neck portion 18 includes a frustoconical portion 20 of reducing diameter and an outwardly directed flange 22. The flange 22 is utilized to double seam a container end to the container body 12 in a conventional manner.

Unlike a three piece container body which has two open ends and a welded side seam, the bottom wall 14 of the container body 12 limits movement of the metal in the side wall during the expansion operation.

Prior to the reshaping operation of the present invention, the side wall 16 of the container body 12 has an initial cylindrical shape having an axial length and a constant radius of curvature, measured from the longitudinal axis of the container, along the axial length. After the reshaping operation, at least a portion of the side wall is expanded radially outward from this initial cylindrical shape.

The reshaping apparatus 10 includes a shaping mandrel 24 extending from a housing 26. The housing 26 is secured to a main frame 28 which may be stationary, or part of a rotatable turret assembly having a plurality of housings and shaping mandrels. If part of a turret assembly, the mainframe may have ten reshaping stations. Such assemblies can reshape 600 containers per minute.

The shaping mandrel 24 includes a plurality of forming segments 30 spaced about an actuator or expander arm 32. Each forming segment 30 includes a radially outward surface 34 for contacting or engaging the inner surface 36 of the container 12 side wall 16. The forming segments 30 are preferably a hardened steel, and are preferably coated with a material to increase the wear capability of the contacting surface 34 of the segment 30 and to reduce friction between the forming segment 30 and the inner surface 36 of the container body 12 side wall 16. The coating material may be, for example, chrome or titanium nitride, although other materials may also be used. In the testing apparatus initially utilized to reshape a drawn and ironed seamless container, the forming segments were coated with chrome.

Unlike the forming segments used in the past to reshape the cylindrical portion of a three piece container, the segments 30 of the apparatus 10 have been modified to enable expansion of the side wall of a drawn and ironed seamless container body. Specifically, the contacting surfaces 34 of the forming segments 30 have been polished to an extremely smooth surface finish. In the past, the surface finish, or rugosity, of the contacting surface was on the order of 20–32 microns. For reshaping the thin walled drawn and ironed aluminum alloy seamless container, a surface finish of about 2–10 microns, and more preferably 2–8 microns is required. When a coating is applied to the contacting surface 34 of the forming segment 30, the contacting surface 34 is first polished to a finish of 2–10 microns. The coating is then applied and the contacting surface 34 is again polished to a finish of 2–10 microns.

Figure 7:
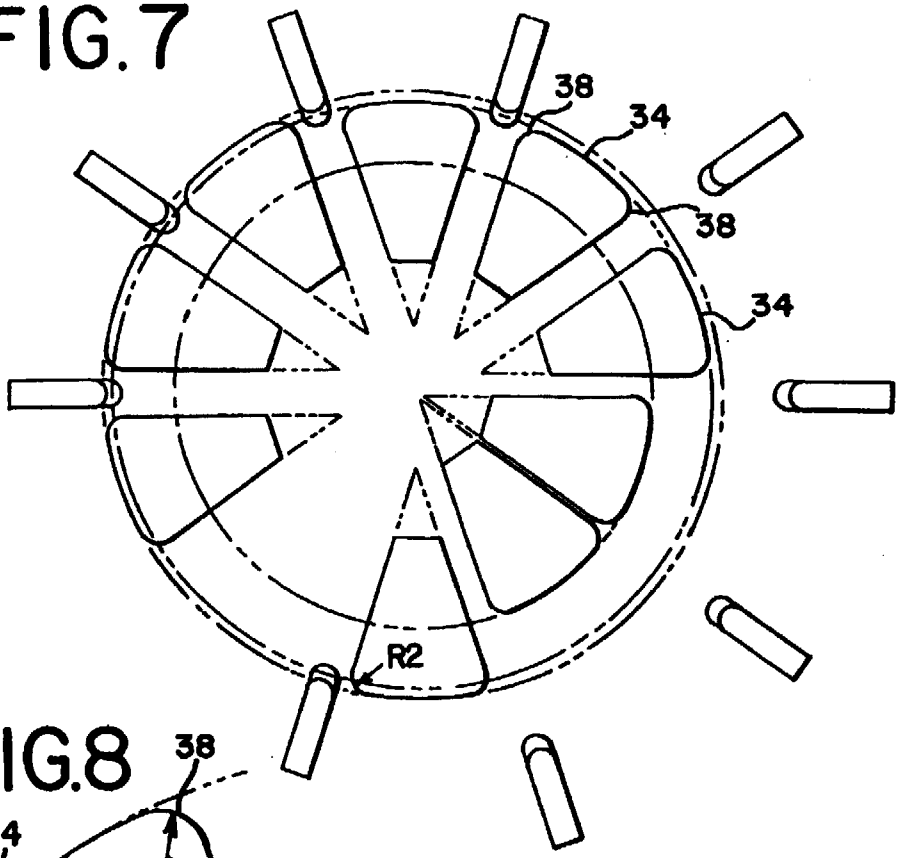
FIG. 7 discloses a cross-sectional view of the forming segments of the present invention.
Figure 8:
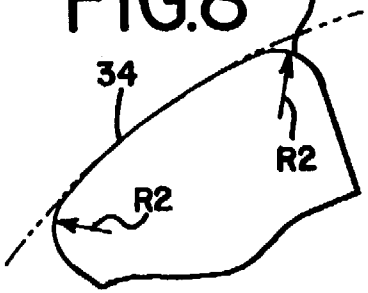
FIG. 8 discloses an enlarged cross-sectional view of the forming segment of the present invention.

In addition to providing a smoother contacting surface 34, the corners 38 on each side of the contacting surface 34 have also been modified for enabling expansion of drawn and ironed seamless container bodies. In the prior art forming segment, the contacting surface terminated at either side in a relatively sharp corner having a radius on the order of about 0.5 millimeters. Such corners, along with the rougher contacting surface, would tend to rip the brittle, work hardened aluminum of the container body 12. As shown in cross-section in FIGS. 7 and 8, the radii R2 of the corners 38 of the forming segments 30 have been significantly increased to about 2–3 millimeters, which is approximately twenty times greater than the wall thickness of the side wall 16 of the container body 12.

Referring again to FIG. 1, the container body 12 is positioned over the shaping mandrel 24 so that the flange 22 abuts against a supporting ring 44 connected to the housing 26. Referring only to the right side of FIG. 1, the forming segment 30 is shown in a collapsed position in which the contacting surface 34 is spaced radially inward from the inner surface 36 of the side wall 16. The forming segment 30 includes a lip 46 at one end which is secured in a channel 48 in the housing 26. The lip 46 is connected to a pin 64 which is positioned in a spring 66. The forming segment 30 also includes a first camming surface 50 and a second camming surface 52 which abut against first and second camming surfaces 54, 56 of the actuator 32. Plastic glide pads 58, 60 are connected to the first and second camming surfaces 50, 52 of the forming segment 30. The first and second camming surfaces 50, 52 of the forming segment 30, and the first and second camming surfaces 54, 56 of the actuator are at an angle with respect to the longitudinal axis 62 of the container body 12.

In operation, as shown on the left side of FIG. 1, the actuator 32 has been moved axially away from the bottom 14 of the container body 12. This axial movement causes the camming surfaces 54, 56 of the actuator 32 to cooperate with the camming surfaces 50, 52 of the forming segment 30 to move the forming segment 30 radially outward toward the inner surface 36 of the side wall 16. The contacting surface 34 of the forming segment 30 contacts or engages the inner surface 36 of the side wall 16 of the container body 12, and expands a portion 68 of the side wall 16 radially outward from the longitudinal axis of the container beyond the initial cylinder of the container body 12.

During the expanding operation, the pin 64 is also moved radially outward and compresses the spring 66. When the expanding of the portion 68 of the side wall 16 is completed, the actuator 32 is moved axially toward the bottom wall 14 of the container body 12 and the spring 66 forces the pin 64 and forming segment 30 back into a collapsed position. The container body 12 may then be removed from the shaping mandrel 24.

As shown in FIG. 1, a lower portion 70 of the side wall 16 is not contacted by the forming segments 30 and maintains the mean average diameter of the initial cylindrical shape of the side wall 16. The expanded portion 68, however, after the operation has a mean average diameter which is greater than the mean average diameter of the lower portion 70.

As can be seen on the left hand side of FIG. 1, the flange 22 of the container body 12, is pulled away from the ring 44 during the reshaping operation.

The container body 12 of FIG. 1 is shown after the reshaping operation in FIGS. 10–13.

Figure 2:
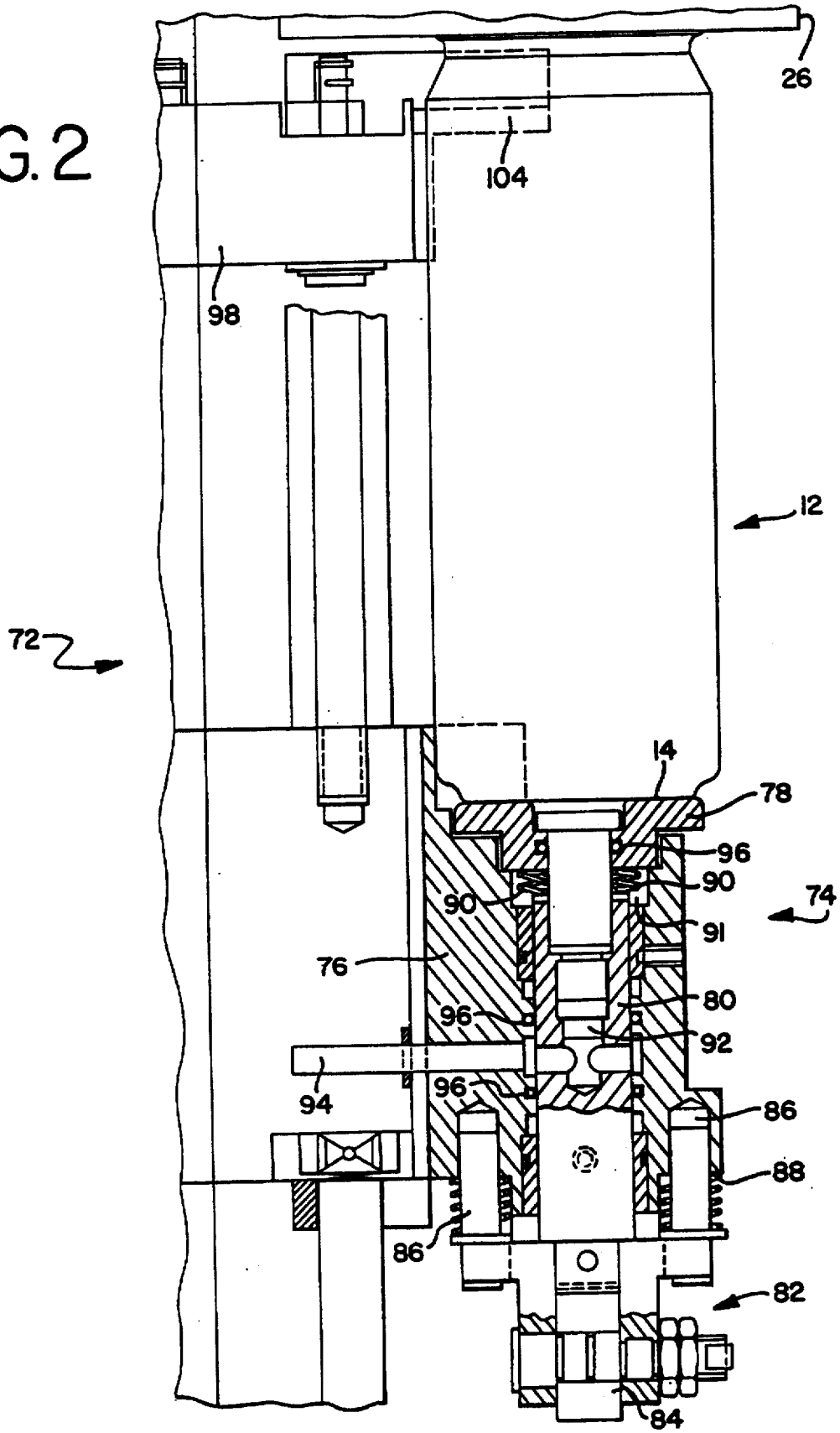
FIG. 2 discloses a cross-sectional view of modified form of the apparatus of FIG. 1.

Referring to FIG. 2, a further modified container reshaping apparatus 72 is disclosed. FIG. 2 discloses elements for applying an axial load force to the container body 12 during the reshaping operation, and for removing the container body 12 from the shaping mandrel 24 (not shown in FIG. 2) after the operation.

The apparatus 72 includes a container body support structure 74 for applying an axial load force to the container body 12. The structure includes a housing 76 connected to a bottom platform support 78. The platform support 78 is axially aligned with the shaping mandrel 24 and abuts the bottom wall 14 of the container body 12.

The platform support 78 is connected to a shaft 80 in the housing 76. The shaft 80 in turn, is connected to a cam follower support bracket 82 which includes a cam follower 84. The cam follower 84 follows a cam (not shown) which effects axial movement of the platform support 78 during the reshaping operation. Accordingly, it is preferred that the entire apparatus 72 is part of turret assembly.

The cam follower support bracket 82 is guided by a plurality of pins 86 which are surround by springs 88. As the forming segments 30 of the shaping mandrel 24 are moved radially outward to engage the inner surface 36 of the side wall 16, the cam follower is cammed axially toward the bottom wall 14 of the container body 12. The pins 86 remain stationary while the cam follower support bracket 82 moves axially toward the bottom wall 14 of the container body 12 compressing the springs 88 and shaft 80 moves with the cam follower support bracket 82 compresses springs 90 positioned in a cavity 91 immediately back of the platform support 78. These springs 90 are preset to the required external load. In this manner, the platform support 78 applies a spring biased external load or force axially to the bottom wall 14 of the container body 12. The external load applied to the bottom wall 14 keeps the flange 22 of the container body 12 pressed against the ring 44 in the housing 26 which contains the shaping mandrel 24. The external load during the reshaping operation is believed to assist in the expansion of the side wall 16. When the reshaping operation is completed, the cam is relieved and the springs 88 force the cam follower 82, and the platform support 78, in a direction axially away from the container body 12.

Additionally, the support structure 74 includes a hollow tube 92 extending from the platform support 78 for effecting a vacuum pressure between the platform support 78 and the bottom wall 14 of the container body 12. The tube 92 is connected to a hose 94 which is connected to a pump (not shown). The vacuum pressure assists in maintaining contact between the platform support 78 and the bottom wall 14 of the container body 12. A plurality of O-rings 96 are position around the tube 92.

The platform support 78 can be used for loading and unloading the container body 12 from the shaping mandrel 24. The vacuum pressure is particularly useful for holding the container body 12 to the platform support during the loading and unloading.

FIG. 2 also discloses a removal sleeve 98 for moving the container body 12 axially away from the shaping mandrel 24 after the reshaping operation. A top view of the removal sleeve 98 is disclosed in FIG. 3.

The removal sleeve 98 includes a main body 100 mounted about two guide rods or posts 102. A first and a second jaw or clamping element 104, 106 are pivotly mounted to the main body 100 by pivots 108, 110. The jaws are designed to engage the neck portion 18 of the container body 12 and assist in removal of the container body 12 from about the shaping mandrel 24.

Figure 4:
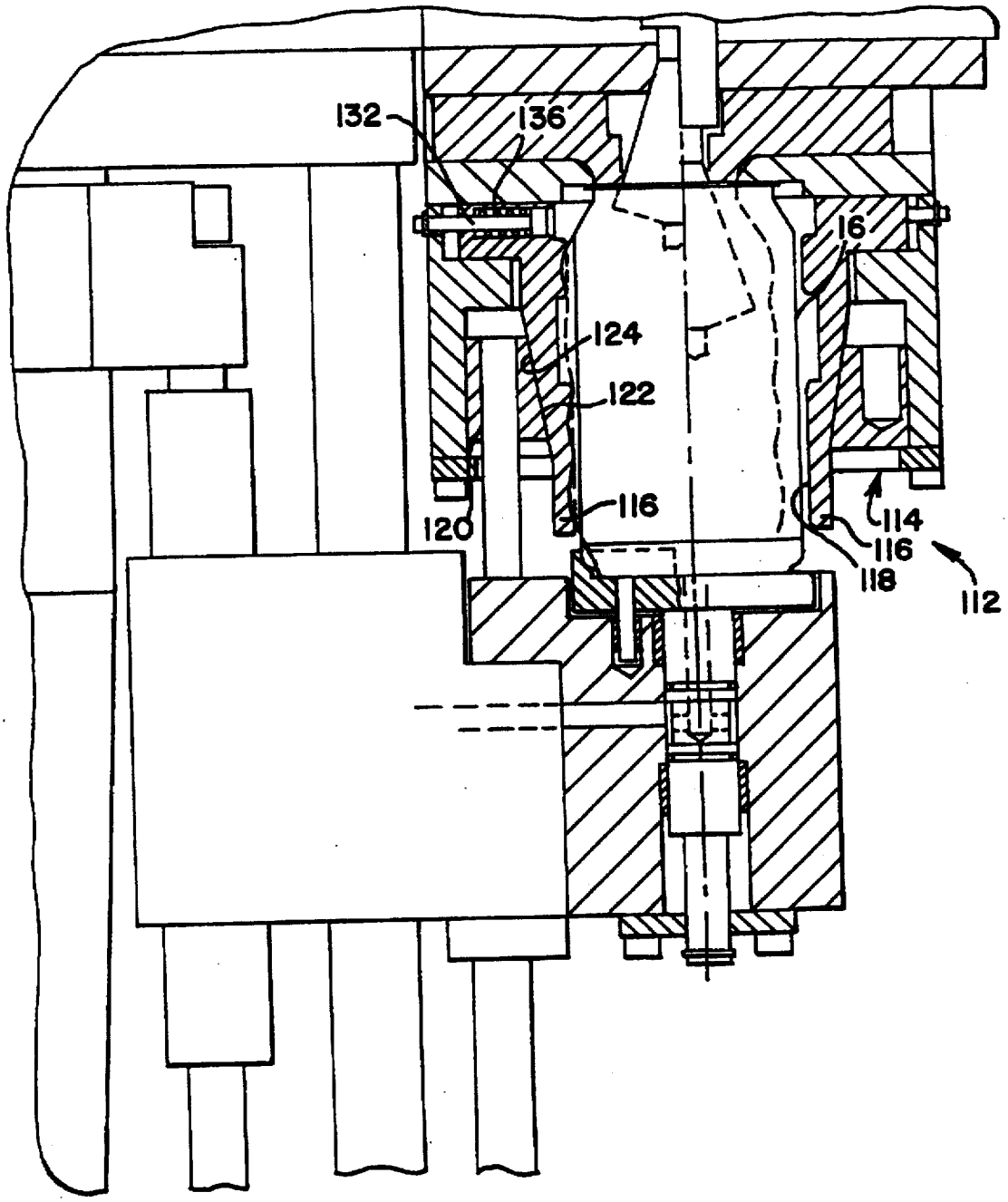
FIG. 4 discloses a cross-sectional view of an alternative embodiment of the apparatus of the present invention.
Figure 9:
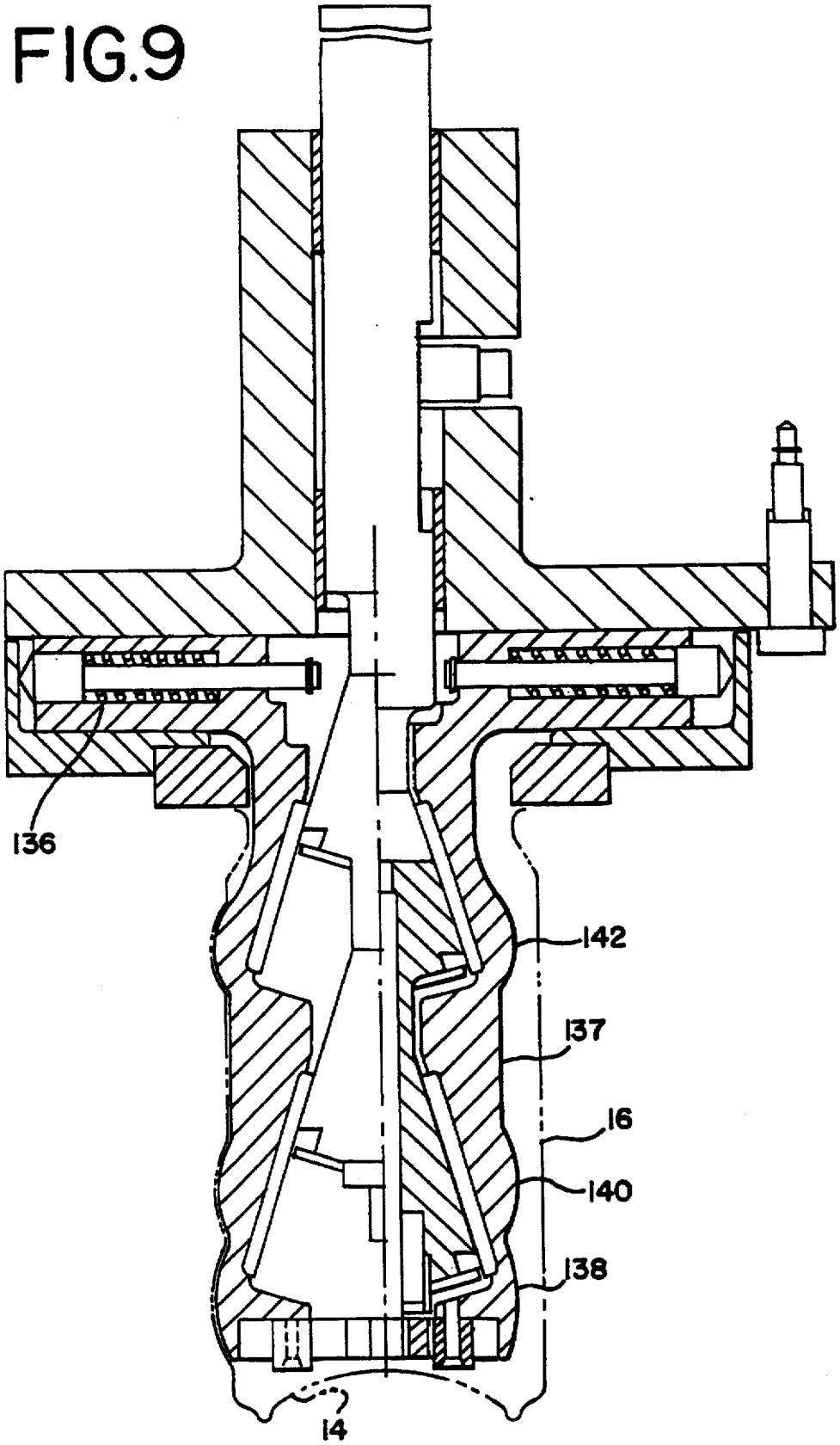
FIG. 9 discloses the apparatus of FIG. 1 with modified forming segments.

In an alternative embodiment disclosed in FIGS. 4 and 5, a reshaping apparatus 112 is disclosed with an external tool 114 for providing radially inward pressure to the expanded portions of the side wall 16. The external tool is used to create radially inwardly deformed segments in the expanded portions of the side wall 16. FIG. 9 discloses the inner mandrel of the apparatus of FIG. 4 with the outer ring and platform support removed for clarity.

The external tool 114 includes a plurality of external forming segments 116 made from hardened steel. Each forming segment 116 includes an external contacting surface for contacting or engaging an outer surface 118 of the side wall 16 of the container body 12. The external forming segments 116 are aligned to contact portions of the side wall 16 of the container body 12 which are in the gaps between the forming segments 30 of the shaping mandrel 24.

The external tool 114 includes an actuator arm 120 having a camming surface 122 which cooperates with a camming surface 124 on the external forming segment 116. Movement along the direction of the longitudinal axis of the container body 12, causes the actuator arm 120 to cam the external forming segment 116 radially inward to deform a portion of the side wall 16 radially inwardly. The actuator arm abuts and compresses a spring 126 partially held in a channel 128 in an upper portion 130 of the actuator arm. After the external forming operation, the spring forces the actuator arm 120 back to its initial position.

The external forming segments 116 are connected to pins 132 at one end 134 of the segments 116. The pins are connected to springs 136. As the actuator arm 120 is moved to its initial position after the operation, the springs 136 force the external forming segments 116 back to their initial positions.

Alternatively, the external forming segments 116 may be fixed in place, that is stationary, with respect to the side wall 16 of the container body 12. As the forming segments 30 of the shaping mandrel 24 move radially outward, portions of the side wall 16 are expanded radially outward into contact with the external forming segments 116 allowing for simultaneous radially inward deformation of the side wall 16.

As disclosed in FIG. 5, the actuator arm 120 is in the form of a ring which has the cross-sectional shape shown in FIG. 4.

In the embodiment disclosed in FIGS. 4, 5 and 9, the forming segments 30 of the shaping mandrel 24 include a modified contacting surface 137. The contacting surface 136 includes a first outwardly convex arcuate portion 138, a second outwardly convex arcuate portion 140 axially spaced from the first arcuate portion 138, and a third outwardly convex arcuate portion 142. These portions 138, 140 and 142 form corresponding expanded portions in the side wall 16 of the container body as disclosed in FIGS. 17–19, and in FIGS. 14–16 without the internally deformed segments. It is evident that a large variety of shapes can be formed by modifying the contacting surface of the forming segments 30 or 116.

In an alternative embodiment, the actuator 24 and the forming segments 30 of the shaping mandrel 24 can be configured so as to progressively allow for reshaping of the side wall 16 of the container body 12. That is, the actuator 24 and the forming segments 30 can be modified to include a dwell time in the camming surfaces to allow, for example, expansion of the first arcuate convex surface 138 before beginning expansion of the second and third arcuate convex surfaces 140, 142. This may decrease the overall stress on the side wall 16 when forming more complex shapes.

Figure 6:
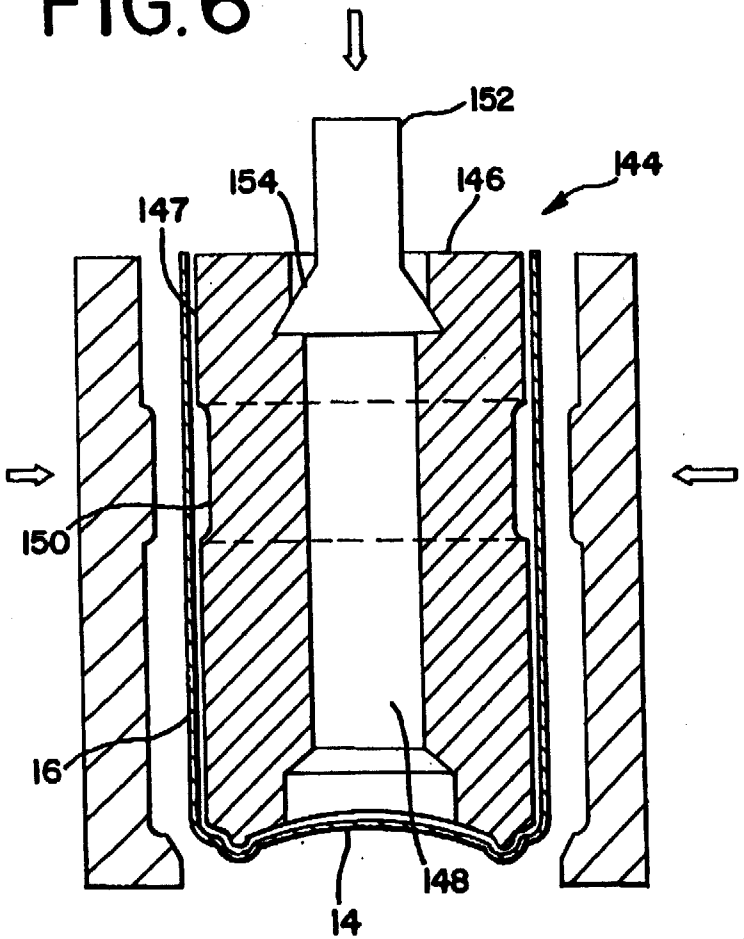
FIG. 6 discloses a cross-sectional view of a further embodiment of the apparatus of the present invention.

In another alternative embodiment, an expanding apparatus 144 is disclosed in FIG. 6. The apparatus 144 includes a generally annular flexible mandrel 146, formed from an elastic material such as rubber or polyurethane, which is positioned in a container body 12. The container body 12 includes a side wall 16 having an initial cylindrical shape. In this embodiment, the container body 12 does not include a portion of reducing diameter in the neck portion 18 of the container body 12. This is necessary to enable insertion and removal of the mandrel 146 from the container body 12 before and after the expanding operation.

The mandrel 146 includes a hollow generally cylindrical channel or bore 148 having a circular cross section centrally located in the mandrel 146. The mandrel 146 also includes an outer shaping surface 147 for contacting the inner surface 36 of the side wall 16. The outer shaping surface 147 includes an exterior annular recessed channel 150 which has diameter which is less than the diameter of the remaining portions of the outer shaping surface 147 of the mandrel 146.

In operation, an expanding plunger or punch 152 is forced through the centrally located channel 148 axially toward the bottom wall 14 of the container body 12. The plunger 152 includes a head portion 154 which has a diameter greater than the diameter of the channel 148. Since the plunger head 154 has a diameter greater than the centrally located channel 148, as the plunger head 154 moves axially toward the bottom wall 14, the outer shaping surface 147 of the mandrel 146 is moved radially outward into contact with the inner surface 36 of the side wall 16 and expands the side wall 16 radially outwardly. As the plunger head 154 moves to a position axially aligned with the annular recessed channel 150, the corresponding portion of the side wall 16 is either not expanded radially outward at all, or depending on the depth of the annular channel 150, is expanded radially outward to a lessor degree than other portions of the side wall 16. In this manner, a barrel shape similar to the shaping mandrel 24 of FIG. 4 can be affected. Because the radially outward deformation or expansion of portions of the side wall 16 results from downward movement (i.e., axially toward the bottom wall 14 of the container body 12) of the plunger head 154, the expansion of the portions of the side wall 16 is carried out gradually rather than all at once. That is, a portion of the side wall 16 proximate the neck portion 18 is expanded before a portion of the side wall proximate the bottom wall 14. As the plunger head 154 passes through any portion of the channel 148, the mandrel 146 resumes its original shape due to the elastic nature of the material.

During the expanding operation using a shaping mandrel 24 with a plurality of forming segments 30, the segments 30 separate as they move radially outward and are spaced circumferentially as they contact the inner surface 36 of the side wall 16. The side wall 16 is thus primarily stretched in the gaps between the contacting surfaces 34 of the forming segments 30 during the expanding operation. This also tends to form crease lines 160 in the expanded portions of the side wall 16 as disclosed in FIG. 10. Such crease lines are not necessarily obtained using the elastic mandrel 146 of FIG. 6.

The outer shaping surface 147 of the mandrel 146 can have a variety of contours or shapes. This will produce a corresponding variety of shapes in the side wall 16 of the container body 12.

As disclosed in FIGS. 10–22, the resultant container body 12 can have a variety of shapes. In all instances, however, the side wall 16 of the container body 12 includes at least one portion which has been expanded radially outward beyond the initial cylindrical shape of the container body, and includes a mean average diameter greater than the mean average diameter of the initial cylindrical shape. Additionally, such portions also have a mean average diameter which is greater than the mean average diameter of the bottom wall portion 14 of the container body 12. For container bodies which include annular outward beading in the bottom wall portion 14, the outermost portion of the beading is considered in calculating the mean average diameter of the bottom wall portion 14.

Figure 10:
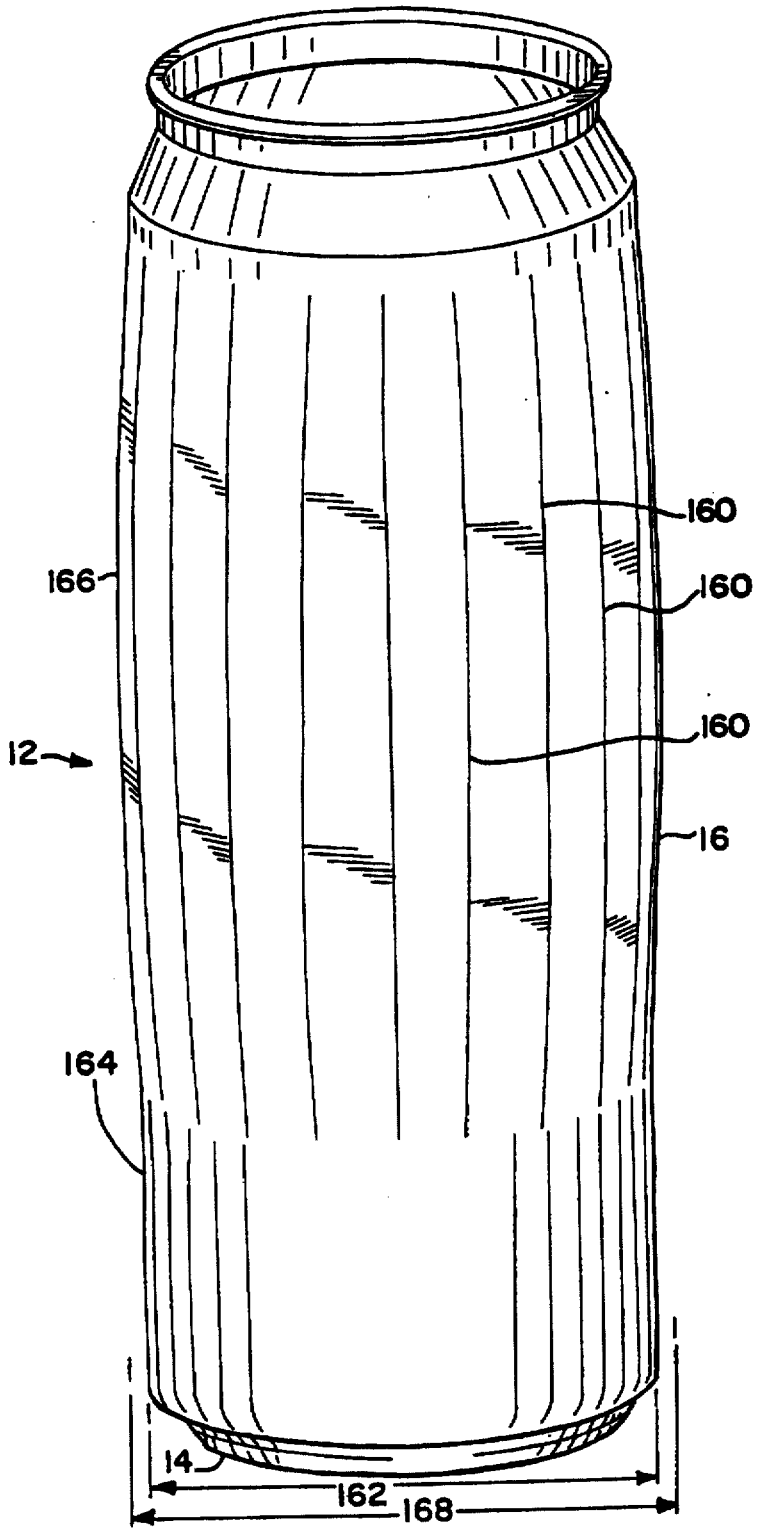
FIG. 10 discloses a perspective view of a reshaped container of the present invention.
Figure 11:
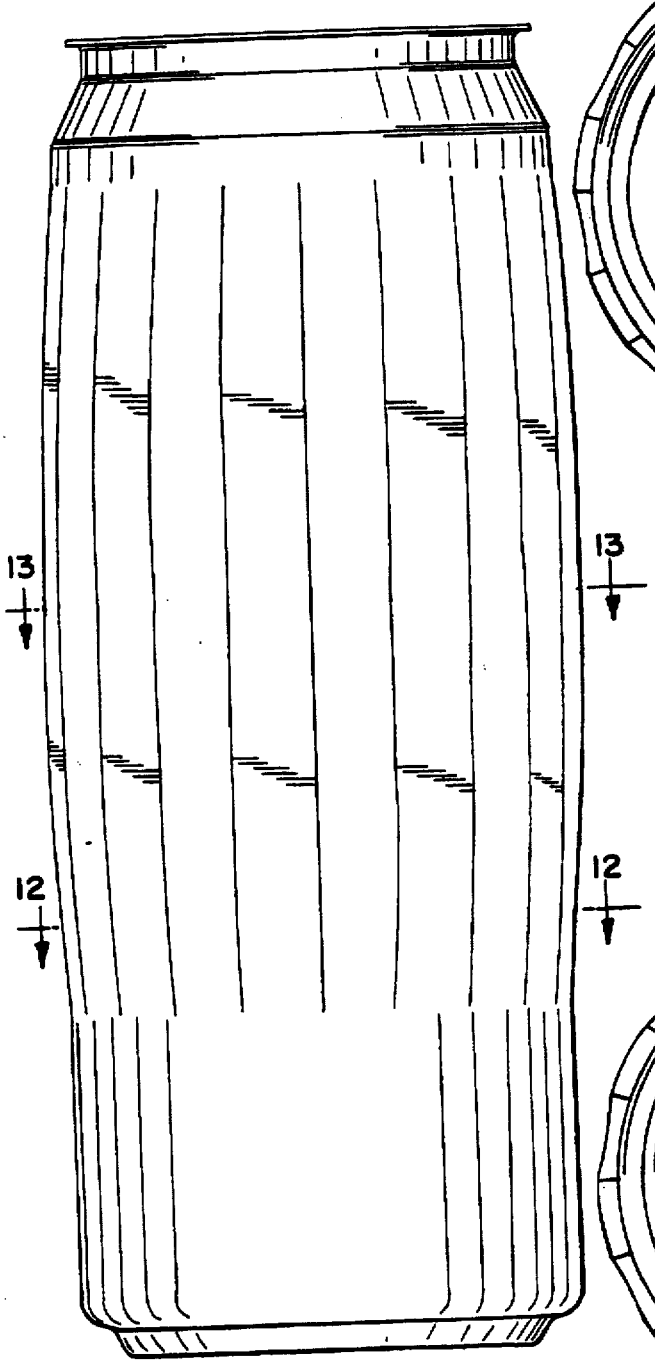
FIG. 11 discloses a side view of the container of FIG. 10.
Figure 12:
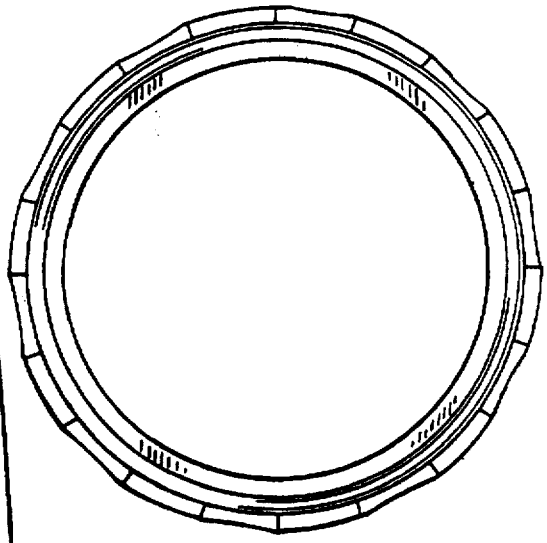
FIG. 12 discloses a cross-sectional view taken along the line 12—12 of FIG. 11.
Figure 13:
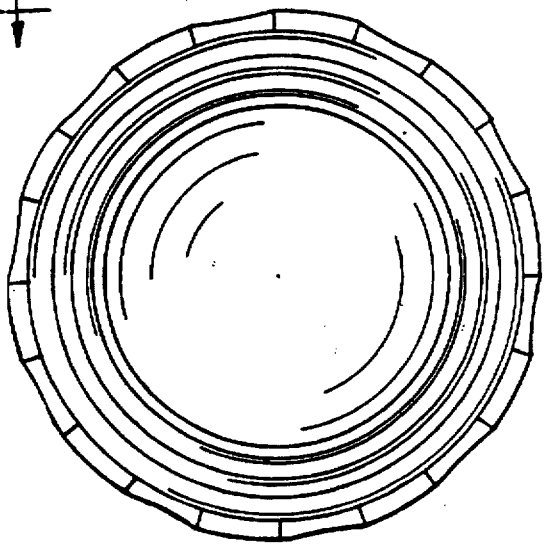
FIG. 13 discloses a cross-sectional view taken along the line 13–13 of FIG. 11.

Referring to FIG. 10, the container body 12 includes a bottom wall portion 14 which has a first mean average diameter 162. The side wall 16 of the container body 12 includes a first portion 164 which has a second mean average diameter approximately equal to the mean average diameter 162 of the bottom wall portion 14 and equal to the mean average diameter of the initial cylindrical shape of the container body. The side wall also includes a second portion 166 which has been expanded radially outward. The second portion 166 has a third mean average diameter 168 which is greater than the mean average diameter of the first portion 164 and the mean average diameter 162 of the bottom wall 14. Crease lines 160 are visible in the second portion 166 from the forming segments 30 of the inner mandrel 24. The material of the side wall is primarily stretched in the gaps between the forming segments during the reshaping operation.

Figure 14:
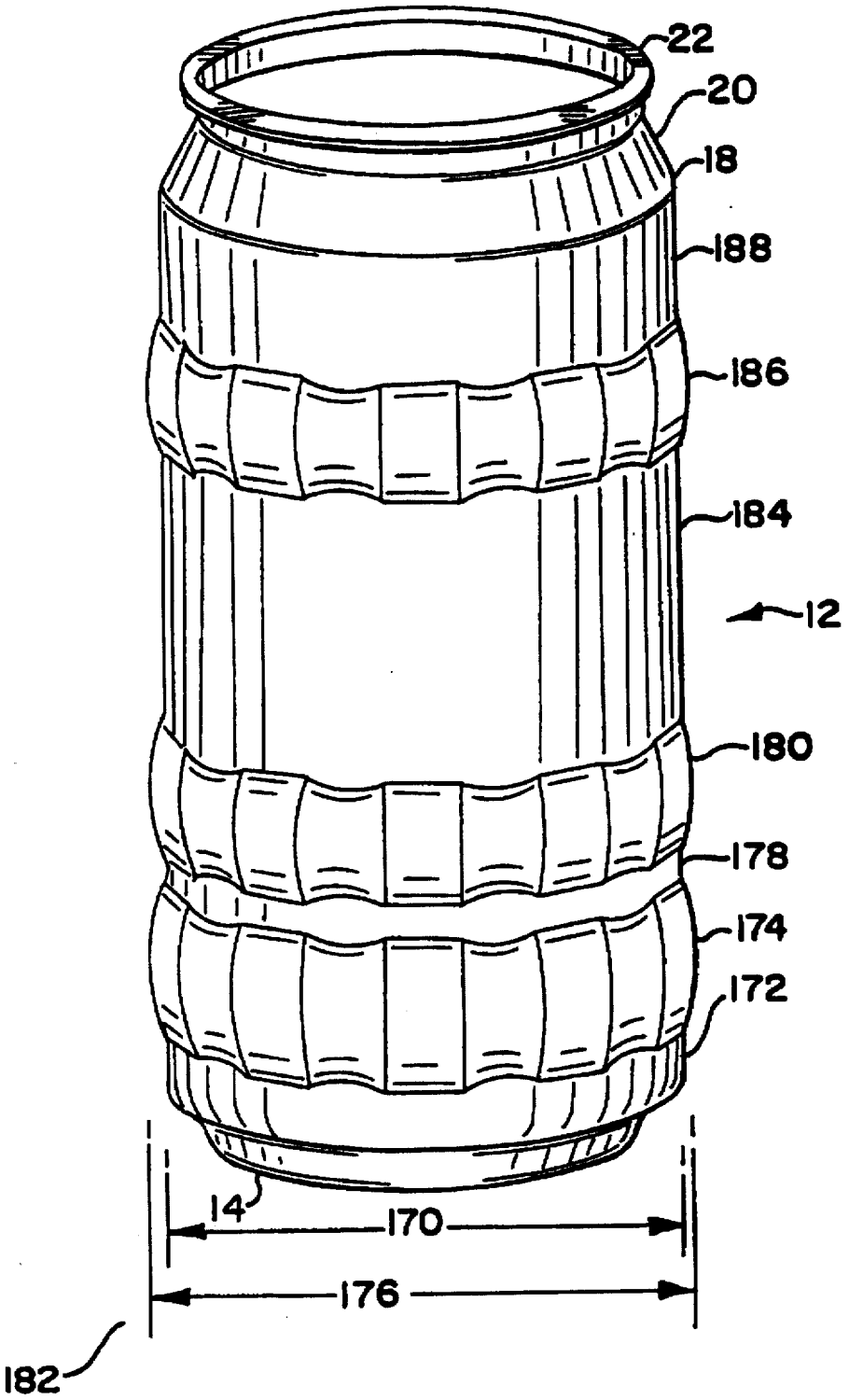
FIG. 14 discloses a perspective view of an alternative form of the container of the present invention.
Figure 15:
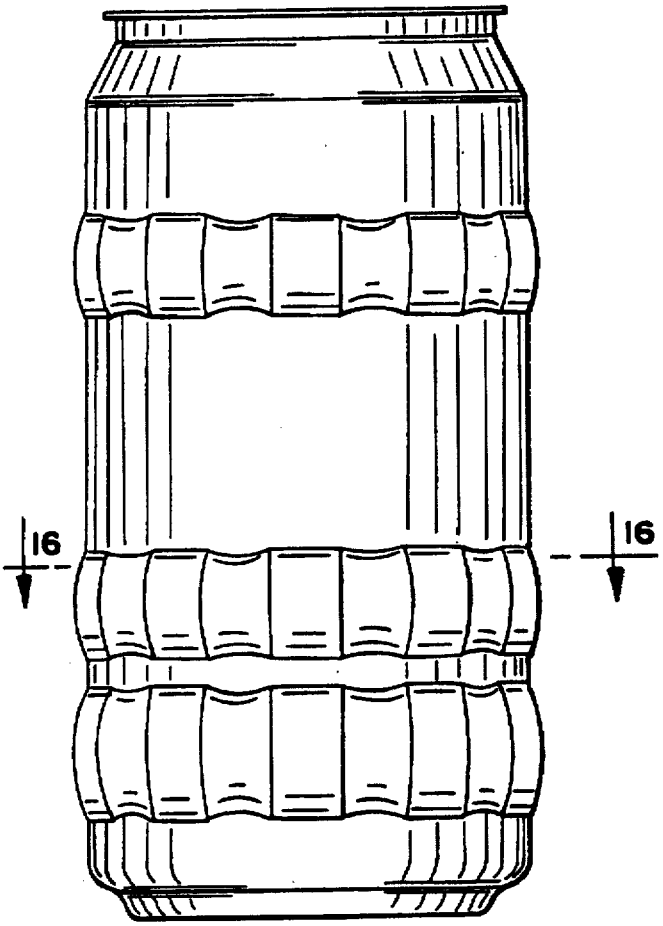
FIG. 15 discloses a side view of the container of FIG. 14.
Figure 16:
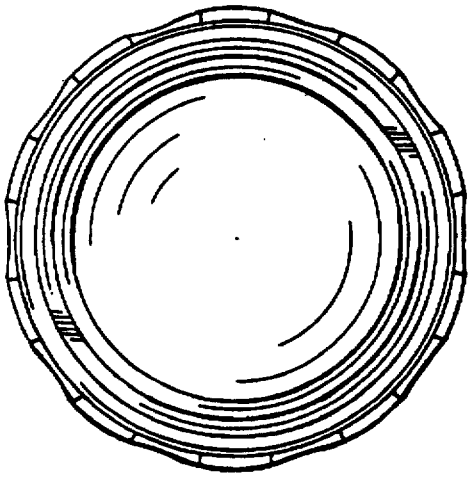
FIG. 16 discloses a cross-sectional view taken along the line 16—16 of FIG. 15.

An alternative container body is disclosed in FIGS. 14–16.This container body 12 includes a bottom wall 14 having a first mean average diameter 170. The side wall 16 includes a first portion 172 which has a second mean average diameter approximately equal to the mean average diameter 170 of the bottom wall portion 14 and equal to the mean average diameter of the initial cylindrical shape of the container body. The side wall 16 also includes a second portion 174 having a third mean average diameter 176 greater than the mean average diameter of the first portion 172 and the mean average diameter 170 of the bottom wall portion 14. The side wall further includes a third portion 178 having a fourth mean average diameter approximately equal to the mean average diameter of the first portion 172. The side wall further includes a fourth portion 180 having a fifth mean average diameter 182 approximately equal to the third mean average diameter 176. The side wall further includes a fifth portion 184 having a mean average diameter approximately equal to the mean average diameter of the first portion, and a sixth portion 186 having a mean average diameter approximately equal to the third mean average diameter. Finally, the side wall includes a seventh portion 188 having a mean average diameter approximately equal to the mean average diameter of the first portion 172.

Figure 17:
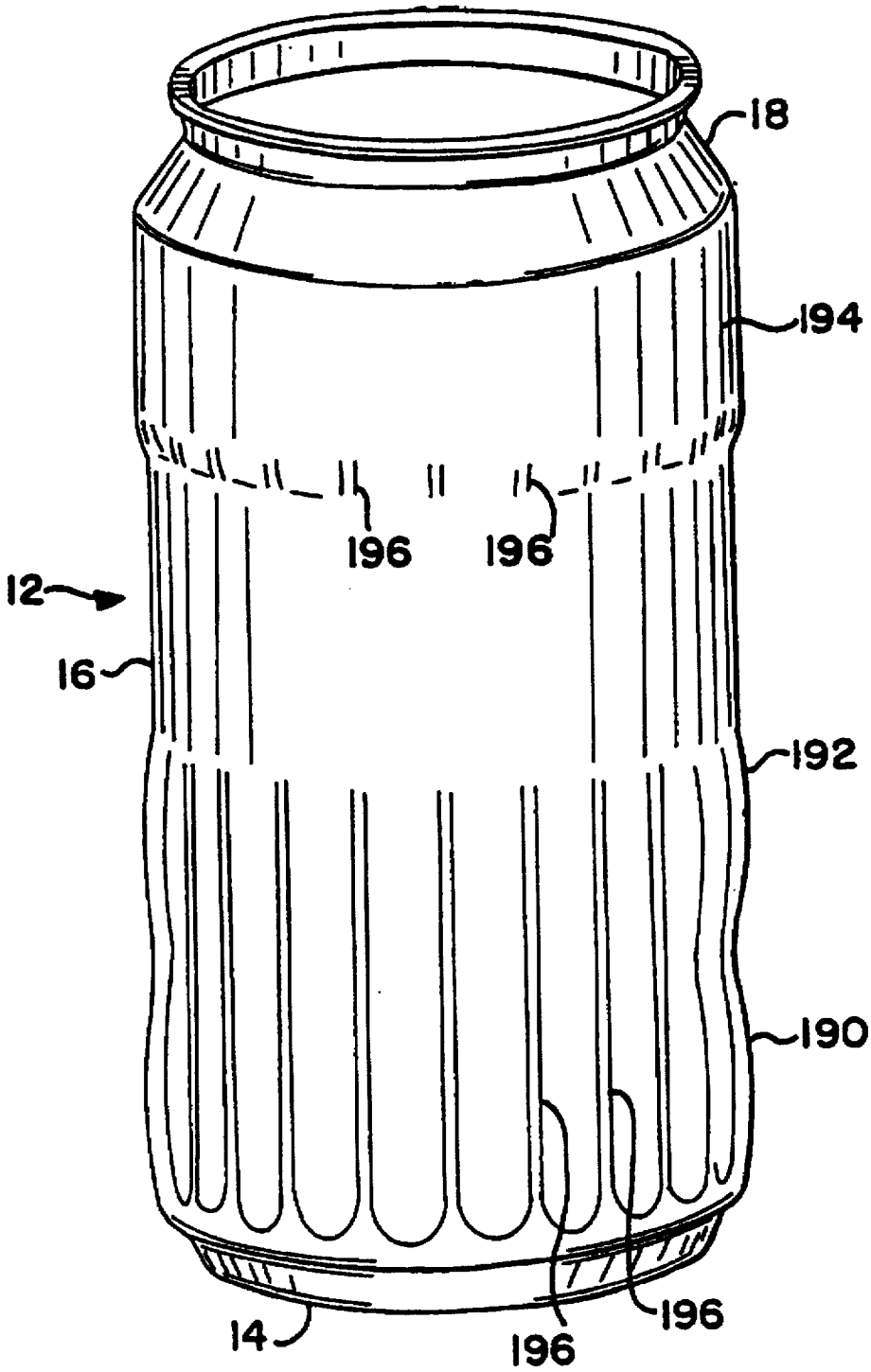
FIG. 17 discloses a perspective view of an alternative form of the container of the present invention.
Figure 18:
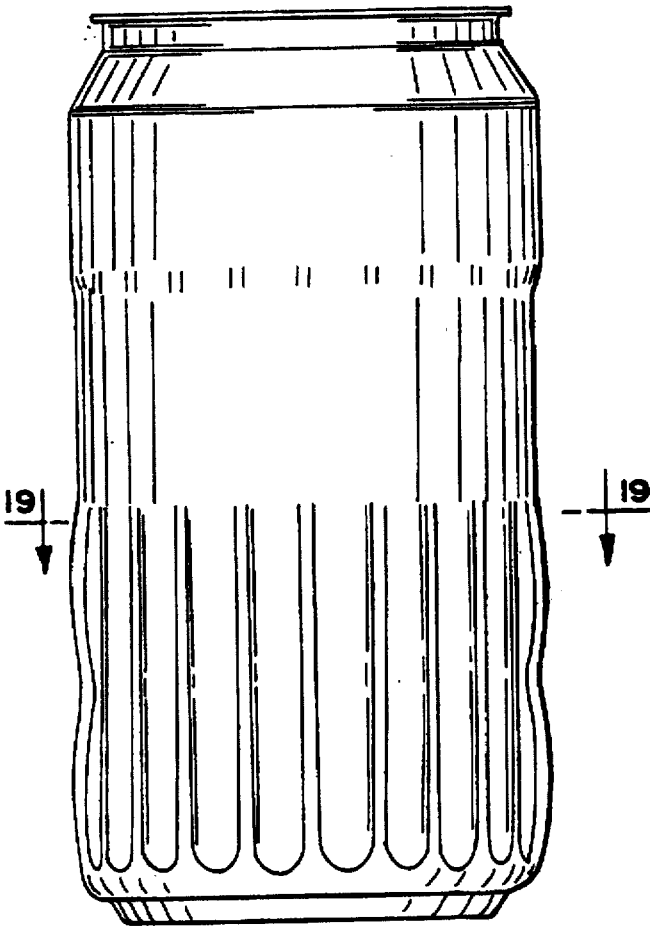
FIG. 18 discloses a side view of the container of FIG. 18.
Figure 19:
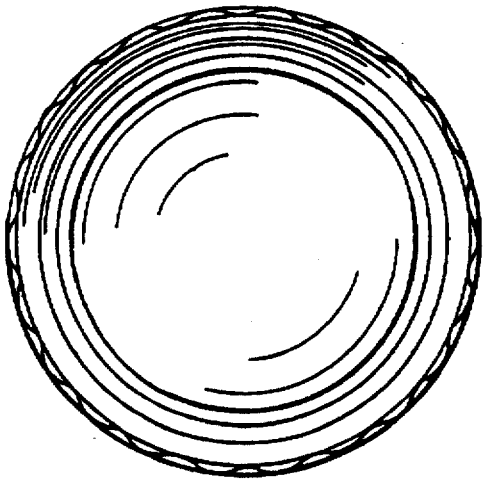
FIG. 19 discloses a cross sectional view taken along the line 19—19 of FIG. 18.

FIGS. 17–19 disclose a further embodiment of a container body 12 having a side wall 16 with first, second and third expanded portions 190, 192, 194. The side wall also include a plurality of inwardly deform segments 196 spaced circumferentially about the side wall 16.

Figure 20:
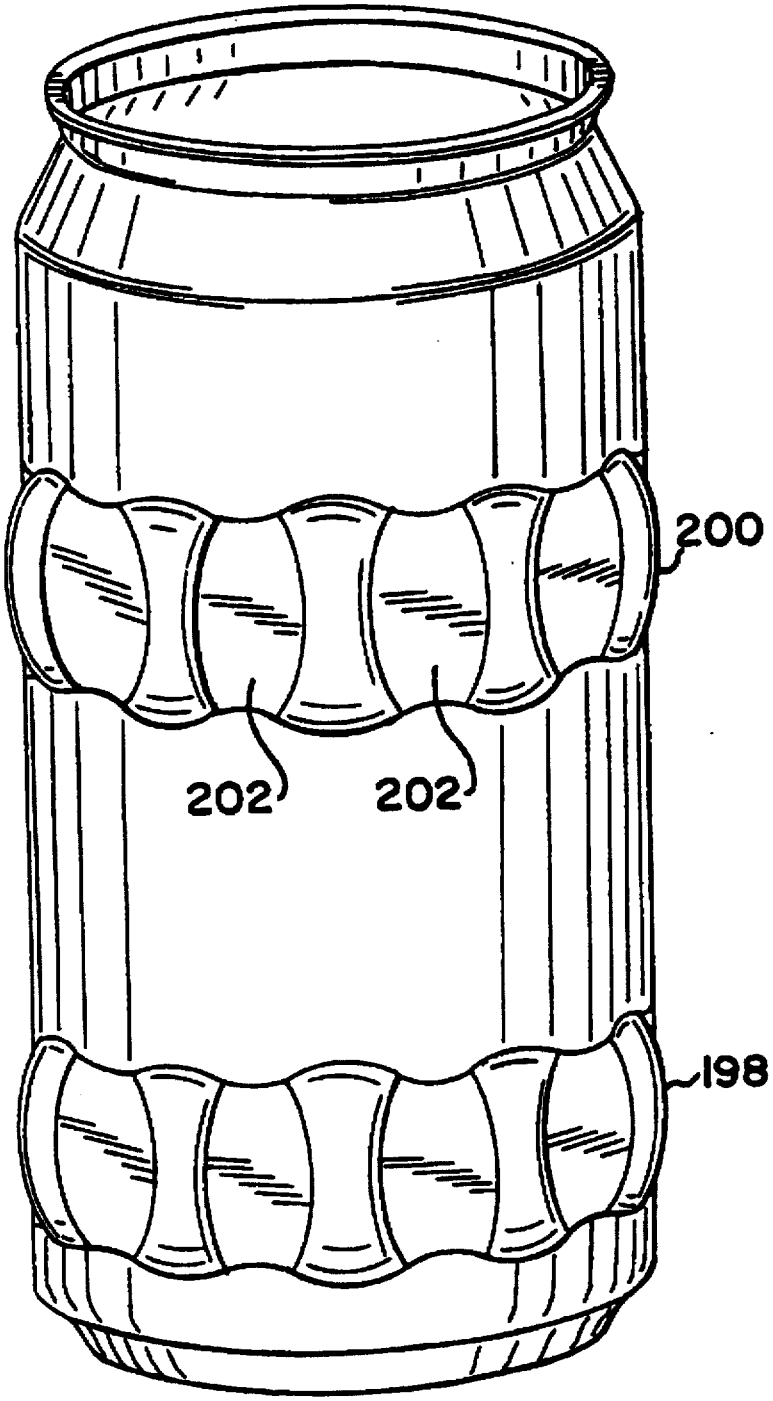
FIG. 20 discloses a perspective view of an alternative container of the present invention.
Figure 22:
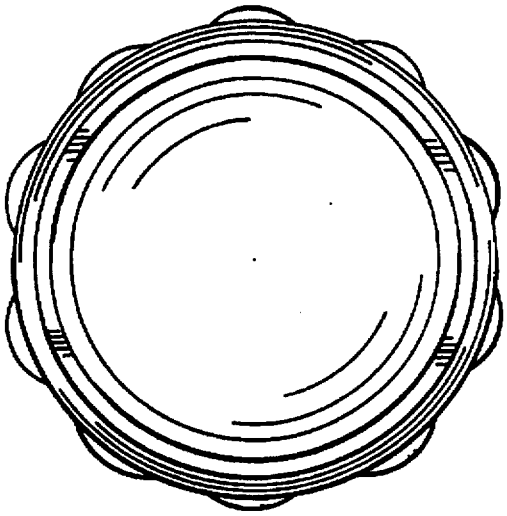
FIG. 22 discloses a cross-sectional view taken along the line 22—22 of FIG. 21.
Figure 21:
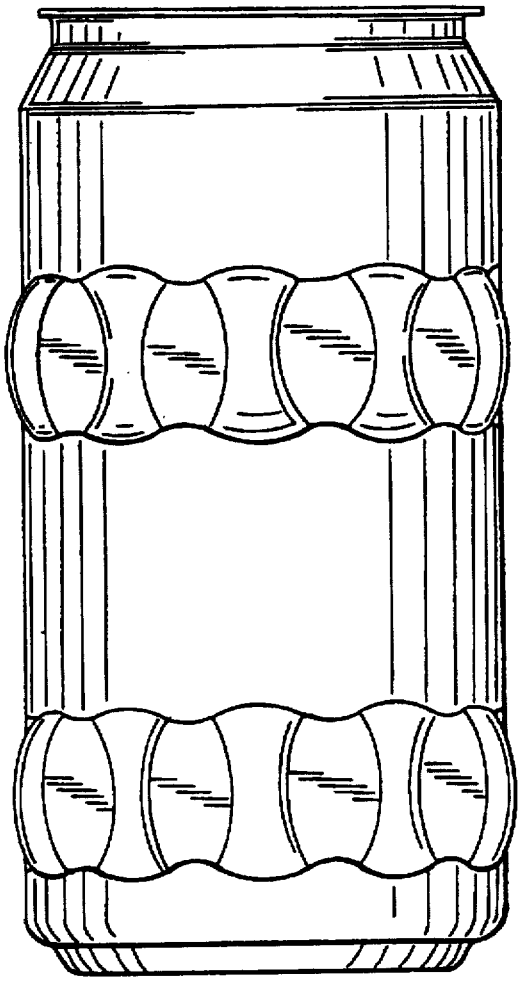
FIG. 21 discloses a side view of the container of FIG. 20.

FIGS. 20–22 disclose a further embodiment of a container body 12 having a side wall 16 with first and second expanded portions 198, 200. The shaping mandrel used to form this container body was configured so that the forming segments were spaced a greater than normal distance when contacting the side wall 16. Slight wrinkles 202 can occur in the gaps between the forming segments.

While specific embodiments have been illustrated and described, numerous modifications come to mind without markedly departing from the spirit of the invention. The scope of protection is thus only intended to be limited by the scope of the accompanying claims.

What we claim is:

1. An apparatus for reshaping a portion of a cylindrical side wall of a drawn and ironed container body, said cylindrical side wall having an initial mean average diameter comprising:

a shaping mandrel connected to a housing, said shaping mandrel including a plurality of expanding forming segments, each of said expanding forming segments having a contacting surface for engaging an interior surface of said side wall of said drawn and ironed container body and expanding a portion of said side wall radially outward, said expanding forming segments moveable from a first collapsed position radially outward to a second engaging position, wherein when said expanding forming segments are moved radially outward to engage said interior surface of said side wall said expanding forming segments are circumferentially space apart to form gaps between each said expanding forming segment; and an external tool for engaging an outer surface of said side wall of said container body during a reshaping operation to apply a radially inward force to said side wall to create radially inwardly deformed segments in said expanded portion of said side wall of said container body, said external tool including a plurality of external forming segments, said external forming segment aligned to contact portions of said side wall of said container in said gaps between said expanding forming segments when in said second engaging position said expanding forming segments and said external forming segments working cooperatively to reshape said portion of said cylindrical side wall of said drawn and ironed container to have a first mean average diameter greater than said initial mean average diameter.

2. The apparatus of claim 1 wherein said external tool comprises a plurality of external forming segments.

3. The apparatus of claim 1 wherein said external tool includes means for moving said external forming segments radially inward.

4. The apparatus of claim 1 wherein said external forming members in said external tool are stationary.

5. The apparatus of claim 1 wherein said contacting surface of said expanding forming segments includes a first curved corner surface on a first side of said contacting surface and a second curved corner surface on a second side of said contacting surface opposed from said first side, said first and second curved surfaces having a radius of curvature of approximately 2–3 millimeters.

* * * * *